United States Patent [19]

Tsuchihashi et al.

[11] 4,125,888

[45] Nov. 14, 1978

[54] METHOD OF LIGHTING FOR COLORED SHADOWS

[75] Inventors: Michihiro Tsuchihashi; Masato Saito; Makoto Yamanoshita, all of Amagasaki; Hidetoshi Katsura, Kamakura; Osamu Myodo, Kamakura; Koichiro Maeyama, Kamakura, all of Japan

[73] Assignee: Mitsubishi Denki Kabushiki Kaisha, Tokyo, Japan

[21] Appl. No.: 768,427

[22] Filed: Feb. 14, 1977

[30] Foreign Application Priority Data

Feb. 27, 1976 [JP] Japan ..... 51-20800

[51] Int. Cl.[2] ..... F21P 5/04

[52] U.S. Cl. ..... 362/231; 362/811; 272/10

[58] Field of Search ..... 240/1 R, 3, 3.1, 6; 272/10; 356/195; 362/811, 33, 227, 228, 230, 231; 350/320

[56] References Cited

U.S. PATENT DOCUMENTS

| | | | |
|---|---|---|---|
| 1,768,812 | 7/1930 | Whiting | 272/10 X |
| 2,673,923 | 3/1954 | Williams | 240/3.1 |
| 3,945,729 | 3/1976 | Rosen | 356/195 X |

*Primary Examiner*—J. D. Miller

*Assistant Examiner*—Peter S. Wong

*Attorney, Agent, or Firm*—Oblon, Fisher, Spivak, McClelland & Maier

[57] ABSTRACT

Beautifully and balancedly colored shadows can be imparted by arranging color lamps in three R, G and B groups and a white light lamp for white light (W group), illuminating objects to obtain colored shadows of the objects, giving the ratio of illuminance by the white light lamp:

$$i_W = \frac{I_W}{I_R + I_G + I_B + I_W} \leqq 0.5$$

wherein $I_W$ designates an illuminance at the part illuminated by only the white light lamp, and also the illuminance in the shadows to the lights of the lamps of the three R, G and B groups; and $I_R$ designates an illuminance at the part illuminated by only the lamp of the R group in the shadow of the object to both of the lights of the lamps of the G group and the B group; $I_G$ designates an illuminance at the part illuminated by only the lamp in the G group in the shadow of the object to both of the lights of the lamps in the R group and the B group and $I_B$ designates an illuminance at the part illuminated by only the lamp in the B group in the shadow of the object to both of the lights of the lamps in the R group and the G group.

4 Claims, 2 Drawing Figures

METHOD OF LIGHTING FOR COLORED SHADOWS

BACKGROUND OF THE INVENTION

The present invention relates to an improved method of lighting for colored shadows, more particularly, it relates to a method of illuminating objects by a plurality of color light sources and a white light source to utilize the effect of colored shadows of the objects wherein a ratio of illuminance by the white light source to those of the color light sources is specified so as to impart the optimum effect.

The method of lighting for colored shadows by arranging color lamps in three R, G and B groups of at least one lamp for yellow to red (R group); at least one lamp for green (G group) and at least one lamp for violet to blue (B group) and illuminating the objects is the novel method of lighting for beautifully colored shadows of the objects which is quite different from the conventional color lighting.

The inventors have found that the optimum appearance of the colored shadows can be attained by balancing illuminances obtained by color light sources in the range of $$0.05 \leqq \frac{I_R}{I_R + I_G + I_B} \leqq 0.85;$$

$$0.05 \leqq \frac{I_G}{I_R + I_G + I_B} \leqq 0.8; \text{ and}$$

$$0.02 \leqq \frac{I_B}{I_R + I_G + I_B} \leqq 0.8$$

wherein $I_R$ designates an illuminance at the part illuminated by only the lamp in the R group in the shadow of the object to both of the lights of the lamps in the G group and the B group; $I_G$ designates an illuminance at the part illuminated by only the lamp of the G group in the shadow of the object to both of the lights of the lamps in the R group and the B group and $I_B$ designates an illuminance at the part illuminated by only the lamp in the B group in the shadow of the object to both of the lights of the lamps in the R group and the G group.

However, in the practical application, it is considered to combine a white light source with the color light sources in the three groups. In the latter case, the condition of the lighting for colored shadows is not satisfactory with the above-mentioned conditions. An improvement has been needed.

SUMMARY OF THE INVENTION

It is an object of the present invention to provide a method of lighting for imparting beautifully and balancedly colored shadows even though a white light source is used.

The object of the present invention can be attained by providing a method of lighting for colored shadows by arranging color light sources in three R, G and B groups of at least one light source for yellow to red (R group); at least one light source for green (G group) and at least one light source for violet to blue (B group) and a white light source for white light (W group) and illuminating objects to obtain colored shadows of the objects to give the ratio of illuminance by the white light source;

$$i_W = \frac{I_W}{I_R + I_G + I_B + I_W} \leqq 0.5$$

wherein $I_W$ designates an illuminance at the part illuminated by only the white light source but the shadows to the lights of the light sources in the R group, G group and B group; $I_R$ designates an illuminance at the part illuminated by only the light source in the R group in the shadow of the object to both of the lights of the light source in the G group and the B group; $I_G$ designates an illuminance at the part illuminated by only the light source in the G group in the shadow of the object to both of the lights of the light sources in the R group and the B group and $I_B$ designates an illuminance at the part illuminated by only the light source in the B group in the shadow of the object to both of the lights of the light sources in the R group and the G group.

When the shadows by the three group lamps are not superposed in the lighting for colored shadows, $I_W$ designates the illuminance given by only the light of the white lamp which is mixed at the colored shadow.

DETAILED DESCRIPTION OF THE PREFERRED EMBODIMENTS

Figure 1:
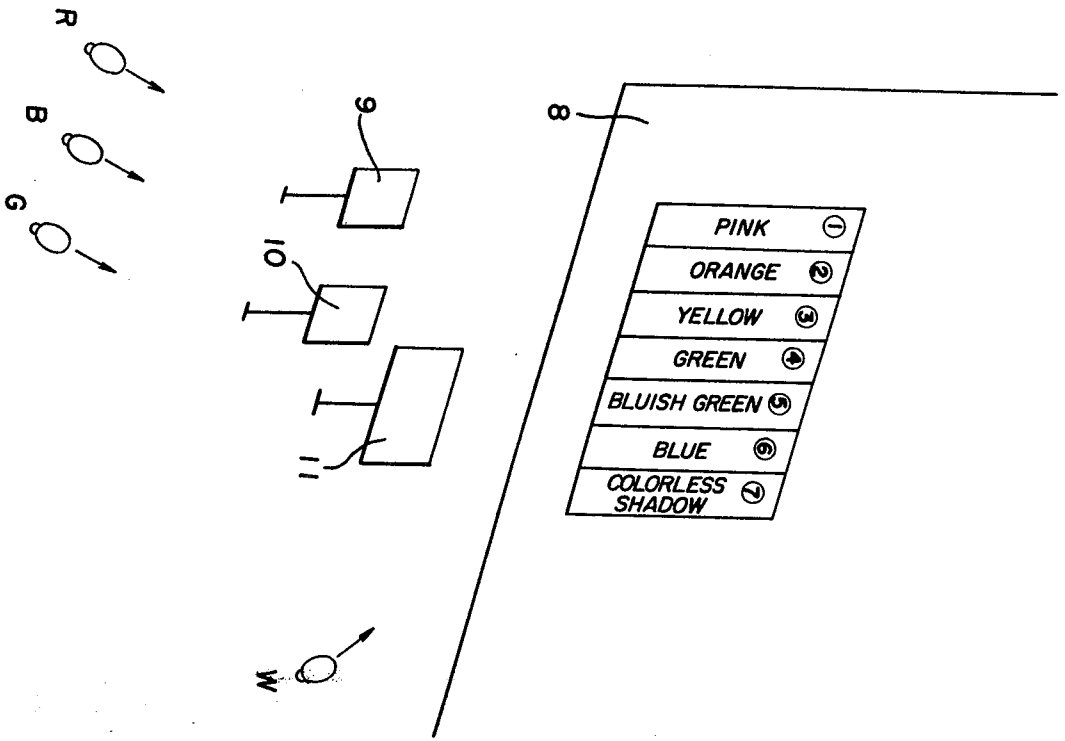
FIG. 1 is a schematic view of one embodiment of the method according to the invention.

In the specification, the light sources are described as lamps.

The color lamps in the R group include a yellow color lamp, an orange color lamp, a red color lamp, a high pressure sodium lamp, an orange metal halide lamp (sodium halide is added) and a red metal halide lamp (lithium halide is added), and the light sources for orange to red color which have a front colored glass plate to give color lights being the same with those of the color lamps.

The color lamps in the G group include a green color lamp and a green metal halide lamp (thallium halide is added), and the light sources for green which have a front colored glass plate to give color lights being the same with those of the color lamps.

The color lamps in the B group include a violet color lamp, a blue color lamp, a violet metal halide lamp (gallium halide is added) and a blue metal halide lamp (indium halide is added), and the light sources for violet to blue which have a front colored glass plate to give color lights being the same with those of the color lamps.

The white light lamp in the W group include an incandescent lamp, a halogen lamp, cool white fluorescent lamp, warm white fluorescent lamp, daylight fluorescent lamp, white fluorescent high pressure mercury lamp, warm white fluorescent high pressure mercury lamp, white metal halide lamp, etc. which impart while light.

Referring to the drawings, the embodiments of the invention will be illustrated.

FIG. 1 is a schematic view of one embodiment of the method of mixed illumination according to the present invention, to show colored shadows, which are displayed on a white wall 8 by illuminating objects 9, 10, and 11 disposed front of the white wall 8 by using the high pressure sodium lamp as the light source in the R group; the blue metal halide lamp (indium halide is added) as the light source in the B group, and the green metal halide lamp (thallium halide is added) as the light source in the G group, and by illuminating the wall 8 by using high pressure mercury lamp as the light source in the W group from a position between the wall 8 and the illuminated objects 9, 10 and 11.

On the wall 8, the part 1 is colored pink; the part 2 is colored orange; the part 3 is colored yellow; the part 4 is colored green; the part 5 is colored bluish green, the part 6 is colored blue, and the part 7 is colorless shadow.

The part 1 is the shadow of the object 9 to the light of the green metal halide lamp and is colored pink by mixing the light of the high pressure sodium lamp and the light of the blue metal halide lamp.

The part 2 is the shadow of the object 9 to both the lights of the blue metal halide lamp and the green metal halide lamp and is colored orange under the illumination of the high pressure sodium lamp.

The part 3 is a shadow of the object 9 to the light of the blue metal halide lamp and is colored yellow by mixing the light of the high presure sodium lamp and the green metal halide lamp.

The part 4 is a shadow of the object 9 to both of the lights of the high pressure sodium lamp and the blue metal halide lamp is colored green under the illumination of the green metal halide lamp.

The part 5 is a shadow of the object 9 to the light of the high pressure sodium lamp and is colored bluish green by mixing the light of the blue metal halide lmp and the light of the green metal halide lamp.

The part 6 is a shadow of the object 9 to the light of the high pressure sodium lamp and a shadow of the object 10 to the light of the green metal halide lamp and is colored blue under the illumination of the blue metal halide lamp.

The part 7 is a shadow of the substances 9, 10, and 11 to three kinds of the lights of the high pressure sodium lamp, the blue metal halide lamp and the green metal halide lamp and is given as a colorless shadow. The colored parts 1–6 and the colorless part 7 are substantially uniformly illuminated by the mercury lamp in the W group.

When the mercury lamp in the W group is turned-off, in the colored shadows on the wall 8, $I_R$ designates an illuminance at the part 2 illuminated by only the high pressure sodium lamp in the R group; $I_G$ designates an illuminance at the part 4 illuminated by only the green metal halide lamp in the G group; and $I_B$ designates an illuminance at the part 6 illuminated by only the blue metal halide lamp in the B group, and $I_W$ designates an illuminance at the part 7 illuminated by only the mercury lamp in the W group appeared on the wall 8 when the mercury lamp in W group is turned on;

$$i_R = \frac{I_R}{I_R + I_G + I_B + I_W}$$

$$i_G = \frac{I_G}{I_R + I_G + I_B + I_W}$$

$$i_B = \frac{I_B}{I_R + I_G + I_B + I_W}$$

-continued $$i_W = \frac{I_W}{I_R + I_G + I_B + I_W}$$

wherein the ratio of $I_R$, $I_G$, $I_B$, and $I_W$ are respectively designated as $i_R$, $i_G$, $i_B$, and $i_W$. The effects under the turn-on condition of the mercury lamp in the W group are measured by changing the value of $i_R$, $i_G$, $i_B$, and $i_W$.

As the results, the effects shown in Table 1, are obtained.

Table 1

| Mark | $i_R$ | $i_G$ | $i_B$ | $i_W$ | Rating |
|---|---|---|---|---|---|
| (1) - 1 | 0.4 | 0.4 | 0.2 | | |
| (1) - 2 | 0.3 | 0.3 | 0.15 | 0.25 | A |
| (1) - 3 | 0.2 | 0.2 | 0.1 | 0.5 | B |
| (1) - 4 | 0.15 | 0.15 | 0.08 | 0.62 | C |
| (2) - 1 | 0.8 | 0.1 | 0.1 | | |
| (2) - 2 | 0.7 | 0.09 | 0.09 | 0.12 | A |
| (2) - 3- | 0.4 | 0.05 | 0.05 | 0.5 | B |
| (2) - 4 | 0.3 | 0.04 | 0.04 | 0.62 | C |
| (3) - 1 | 0.2 | 0.7 | 0.1 | | |
| (3) - 2 | 0.16 | 0.56 | 0.08 | 0.2 | A |
| (3) - 3 | 0.1 | 0.35 | 0.05 | 0.5 | B |
| (3) - 4 | 0.07 | 0.23 | 0.03 | 0.67 | C |
| (4) - 1 | 0.1 | 0.2 | 0.7 | | |
| (4) - 2 | 0.08 | 0.16 | 0.56 | 0.2 | A |
| (4) - 3 | 0.05 | 0.1 | 0.35 | 0.5 | B |
| (4) - 4 | 0.03 | 0.07 | 0.23 | 0.67 | C |

The designations A, B and C in the column of the rating in Table 1 respectively show the following facts in comparison with beautifulness of the colored shadows given on the wall 8 under the illumination by only colored light sources in the three R, G and B groups without the illumination by using the mercury lamp in the W group.

A: the shadows have beautiful colored appearance without a substantial influence by the W group;

B: the shadows are slightly inferior to those of A, but have fairly good appearance;

C: the shadows are quite less colored by the influence of the mercury lamp in the W group.

When the rating is A or B, beautiful colored shadows are given in practice to attain the lighting by the three groups of the colored light sources under illumination of the mercury lamp in the W group.

The critical points of the rating A, B and C is studied in detail. It has been found that the rating A includes the range of less than 0.25 for $i_W$; the rating B includes the range of $0.25 < i_W \leqq 0.5$ and the rating C includes the range of more than 0.5 for $i_W$. Accordingly, when $i_W$ is kept in less than 0.5, excellent colored shadows can be practically given even though it is illuminated by a white light lamp. The range of less than 0.25 for $i_W$ is an optimum condition for satisfying the purpose of the invention.

Figure 2:
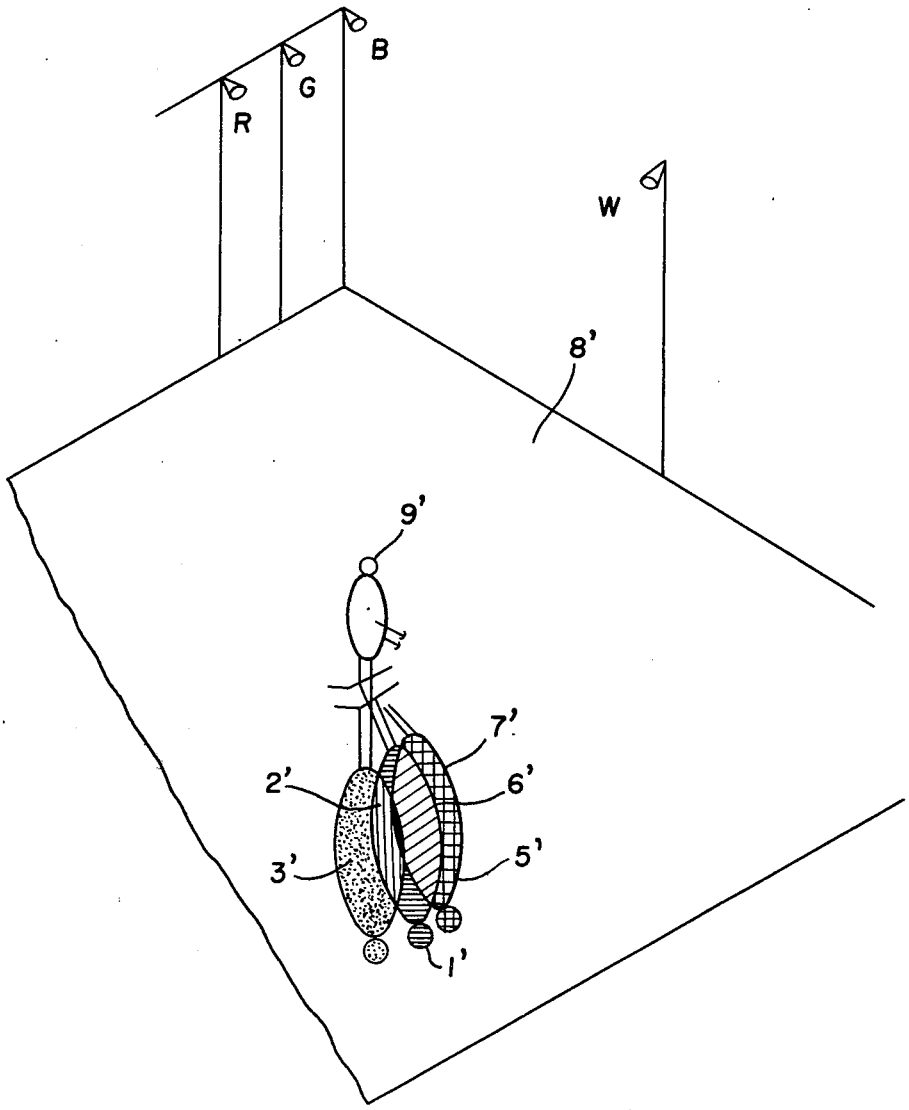
FIG. 2 is a schematic view of the other embodiment, wherein R designates a yellow-red lamp; G designates a green lamp; B designates a violet-blue lamp; W designates a white light lamp.

FIG. 2 is a schematic view of the other embodiment according to the invention, to show colored shadows which are displayed on the snow surface 8' by illuminating a skier as the object 9' by using respectively the high pressure sodium lamp as the light source in the R group; the green halide lamp (thallium halide is added) as the light source in the G group; the blue halide lamp (indium halide is added) as the light source in the B group and the mercury lamp as the light source in the W group.

On the snow surface 8', the part 3' is colored in yellow; the part 2' is colored in orange; the part 1' is colored in pink; the part 6' is colored in blue and the part 5' is colored in bluish green respectively.

The part 7' is not colored to result in a colorless shadow. The colorless shadow of the object 9' is also formed by the mercury lamp in the W group although it is not shown in the FIG. 2.

The illuminances for the parts 1', 2', 3', 5', 6' and 7' at the positions to give 34 lux of $I_R$, 16 lux of $I_G$ and 7 lux of $I_B$ are measured wherein $I_R$ designates an illuminance at the part illuminated by only the high pressure sodium lamp under the turn-off condition of the mercury lamp in the W group; $I_G$ designates an illuminance at the part illuminated by only the green halide lamp and $I_B$ designates an illuminance at the part illuminated by only the blue metal halide lamp.

The results are shown in Table 2.

The illuminances at the shadow parts 1', 2', 3', 5', 6', and 7' under varying the illuminance $I_W$ by the white fluorescent high pressure mercury lamp by varying the aiming of the white fluorescent high pressure mercury lamp in the W group and the effects of colored shadows are measured with the rating A, B and C, of Table 1.

The results are shown in Table 2.

Table 2

| | | | | Illuminance (lux) | | | | | | |
|---|---|---|---|---|---|---|---|---|---|---|
| $i_R$ | $i_G$ | $i_B$ | $i_W$ | part(3') | part(2') | part(1') | part(6') | part(5') | part(7') | Rating |
| 0.60 | 0.28 | 0.12 | 0 | 50 | 34 | 41 | 7 | 23 | 2 | |
| 0.55 | 0.26 | 0.11 | 0.08 | 55 | 39 | 46 | 12 | 28 | 7 | A |
| 0.47 | 0.22 | 0.10 | 0.21 | 65 | 49 | 56 | 22 | 38 | 17 | A |
| 0.44 | 0.21 | 0.09 | 0.26 | 70 | 54 | 61 | 27 | 43 | 22 | B |
| 0.30 | 0.14 | 0.06 | 0.50 | 107 | 91 | 98 | 64 | 80 | 59 | B |
| 0.22 | 0.10 | 0.05 | 0.63 | 148 | 132 | 139 | 105 | 121 | 100 | C |

In Table 2, the beauty of the colored shadows is not obtained in the ratio $i_W$ of more than 0.5 but it is obtained in the ratio $i_W$ of less than 0.5. The optimum effect for satisfying the purpose of the invention is attained in the ratio $i_W$ of less than 0.25.

In the embodiments, the high pressure sodium lamp was used as the lamp in the R group and the green metal halide lamp (thallium halide is added) was used as the lamp in the G group and the blue metal halide lamp (indium halide is added) was used as the lamp in the B group. However, similar effects can be attained by selecting the desired ratio $i_W$ when the lamps specified in the above-mentioned groups are used. The similar effects can be also attained by using a white light source and covering the front of the light source with colored glass plates to give colored light instead of the colored lamps in the groups. Thus lighting for the beautifully colored shadows can be obtained. Moreover, the positions of the lamps are not limited to arrange on one line but to give desired arrangements and number of the lamps.

As stated above, in accordance with the invention, it has been attained to combine lighting by colored light sources in the three groups and the lighting by the white color light source under selecting suitable condition for illuminance of the white light source illuminated to the place to which the lighting is given by the light sources in the three groups.

The effect in the practical application is remarkably high.

What is claimed is:

1. A method of lighting for colored shadows which comprises arranging color light sources in three R, G and B groups of at least one light source for yellow to red (R group); at least one light source for green (G group) and at least one light source for violet to blue (B group) and a white light source for white light (W group) and illuminating objects to obtain colored shadows of the objects to give the ratio of illuminance by the white light source;

$$i_W = \frac{I_W}{I_R + I_G + I_B + I_W} \leqq 0.5$$

wherein $I_W$ designates an illuminance at the part illuminated by only the white light source but the shadows to the lights of the light sources in the R group, G group and B group; $I_R$ designates an illuminance at the part illuminated by only the light source in the R group in the shadow of the object to both of the lights and of the light source in the G group and the B group; $I_G$ designates an illuminance at the part illuminated by only the light source in the G group in the shadow of the object to both of the lights of the light sources in the R group and the B group and $I_B$ designates an illuminance at the part illuminated by only the light source in the B group in the shadow of the object to both of the lights of the light sources in the R group and the G group.

2. A method of lighting for colored shadows according to claim 1, wherein the arranging step includes arranging color light sources in three R, G and B groups of at least one light source for yellow to red (R group); at least one light source for green (G group) and at least one light source for violet to blue (B group) and a white light source for white light (W group); and said white light source in the W group is an incandescent lamp, a halogen lamp, a warm white fluorescent lamp, a daylight fluorescent lamp, a white fluorescent high pressure mercury lamp, a warm white fluorescent high pressure mercury lamp, or a white metal halide lamp.

3. A method of lighting for colored shadows according to claim 1, wherein the arranging step includes arranging color light sources in three R, G and B groups of at least one light source for yellow to Red (R group); at least one light source for green (G group) and at least one light source for violet to blue (B group) and a white light source for white light (W group); and the light source in the R group is a yellow color lamp, an orange color lamp, a red color lamp, a high pressure sodium lamp, an orange metal halide lamp (sodium halide is added) and a red metal halide lamp (lithium halide is added), a lamp having a front orange-red color glass plate; and the light source in the G group is a green color lamp and a green metal halide lamp (thallium halide is added), or a lamp having a front green color glass plate; and the light source in the B group is a violet color lamp, a blue color lamp, a violet metal halide lamp (gallium halide is added) and a blue metal halide lamp (indium halide is added), or a lamp having a front violet-blue color glass.

4. A method of lighting for colored shadows according to claim 1, wherein the illuminating step includes illuminating objects to obtain colored shadows of the objects to give the ratio of illuminance by the white light source;

$$i_w = \frac{I_W}{I_R + I_G + I_B + I_W} \leqq 0.5$$

wherein Iw designates an illuminance at the part illuminated by only the white light source but the shadows to the lights of the light sources in the R group, G group and B group; $I_R$ designates an illuminance at the part illuminated by only the light source in the R group in the shadow of the objects to both the lights of the light source in the G group and the B group; $I_G$ designates an illuminance at the part illuminated by only the light source in the G group in the shadow of the object to both of the lights of the light sources in the R group and the B group and $I_B$ designates an illuminance at the part illuminated by only the light source in the B group in the shadow of the object to both of the lights of the light sources in the R group and the G group; wherein the illuminances by the color light sources are balanced in the range of $$0.05 \leqq \frac{I_R}{I_R + I_G + I_B} \leqq 0.85;$$

$$0.05 \leqq \frac{I_G}{I_R + I_G + I_B} \leqq 0.8; \text{ and}$$

$$0.02 \leqq \frac{I_B}{I_R + I_G + I_B} \leqq 0.8$$

* * * * *